US008269694B2

(12) United States Patent
Shiozaki et al.

(10) Patent No.: US 8,269,694 B2
(45) Date of Patent: Sep. 18, 2012

(54) METHOD FOR DRIVING PLASMA DISPLAY PANEL

(75) Inventors: Yuya Shiozaki, Chuo (JP); Hitoshi Fujimura, Chuo (JP); Kazuo Yahagi, Chuo (JP); Tsutomu Tokunaga, Chuo (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 810 days.

(21) Appl. No.: 12/207,939

(22) Filed: Sep. 10, 2008

(65) Prior Publication Data

US 2009/0231237 A1 Sep. 17, 2009

(30) Foreign Application Priority Data

Mar. 13, 2008 (JP) ..... 2008-064243

(51) Int. Cl.
*G09G 3/28* (2006.01)

(52) U.S. Cl. ..... 345/63

(58) Field of Classification Search ..... 345/63
See application file for complete search history.

(56) References Cited

U.S. PATENT DOCUMENTS 6,295,040 B1 * 9/2001 Nhan et al. ..... 345/60
2003/0030598 A1 * 2/2003 Kanazawa et al. ..... 345/60
2006/0208967 A1 * 9/2006 Onozawa et al. ..... 345/60
2006/0232508 A1 * 10/2006 Furukawa et al. ..... 345/60
2009/0091515 A1 * 4/2009 Kim et al. ..... 345/60

FOREIGN PATENT DOCUMENTS

JP 2000-029431 * 1/2000
JP 2006-243002 9/2006

* cited by examiner

*Primary Examiner* — Alexander S Beck
*Assistant Examiner* — Mihir Rayan
(74) *Attorney, Agent, or Firm* — Drinker Biddle & Reath LLP

(57) ABSTRACT

A method for driving a plasma display panel (PDP) that can increase dark contrast without causing erroneous discharges is provided. A unit display period is divided into a plurality of subfields. A reset process and a sustain process are performed in one of the subfields. In the reset process, a reset pulse is applied to row electrodes of the PDP to initialize each discharge cell to an emission mode (or non-emission mode). In the sustain process, a sustain discharge is repeatedly generated a number of times, corresponding to the number of times a sustain pulse is to be applied, in those discharge cells that are in the emission mode. In this case, a peak potential of the reset pulse is changed based on the number of those discharge cells that are maintained in the non-emission mode during the unit display period and the number of times the sustain pulse is to be applied in the sustain process in this subfield.

5 Claims, 10 Drawing Sheets

FIG. 3

| GRAY LEVEL | DATA CONVERSION TABLE | | | | | | | | | | | | | | | LIGHT EMISSION PATTERN | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | 13 | 14 | SF 1 | SF 2 | SF 3 | SF 4 | SF 5 | SF 6 | SF 7 | SF 8 | SF 9 | SF 10 | SF 11 | SF 12 | SF 13 | SF 14 | |
| 1ST | 0000 | 0 | 0 | 0 | 0 | 0 | 0 | 0 | 0 | 0 | 0 | 0 | 0 | 0 | 0 | | | | | | | | | | | | | | | 0 |
| 2ND | 0001 | 1 | 0 | 0 | 0 | 0 | 0 | 0 | 0 | 0 | 0 | 0 | 0 | 0 | 0 | □ | | | | | | | | | | | | | | $\alpha$ |
| 3RD | 0010 | 0 | 1 | 1 | 0 | 0 | 0 | 0 | 0 | 0 | 0 | 0 | 0 | 0 | 0 | | ◎ | ● | | | | | | | | | | | | 1 |
| 4TH | 0011 | 1 | 1 | 1 | 0 | 0 | 0 | 0 | 0 | 0 | 0 | 0 | 0 | 0 | 0 | □ | ◎ | ● | | | | | | | | | | | | $1+\alpha$ |
| 5TH | 0100 | 1 | 1 | 0 | 1 | 0 | 0 | 0 | 0 | 0 | 0 | 0 | 0 | 0 | 0 | □ | ◎ | ○ | ● | | | | | | | | | | | $3+\alpha$ |
| 6TH | 0101 | 1 | 1 | 0 | 0 | 1 | 0 | 0 | 0 | 0 | 0 | 0 | 0 | 0 | 0 | □ | ◎ | ○ | ○ | ● | | | | | | | | | | $9+\alpha$ |
| 7TH | 0110 | 1 | 1 | 0 | 0 | 0 | 1 | 0 | 0 | 0 | 0 | 0 | 0 | 0 | 0 | □ | ◎ | ○ | ○ | ○ | ● | | | | | | | | | $17+\alpha$ |
| 8TH | 0111 | 1 | 1 | 0 | 0 | 0 | 0 | 1 | 0 | 0 | 0 | 0 | 0 | 0 | 0 | □ | ◎ | ○ | ○ | ○ | ○ | ● | | | | | | | | $27+\alpha$ |
| 9TH | 1000 | 1 | 1 | 0 | 0 | 0 | 0 | 0 | 1 | 0 | 0 | 0 | 0 | 0 | 0 | □ | ◎ | ○ | ○ | ○ | ○ | ○ | ● | | | | | | | $39+\alpha$ |
| 10TH | 1001 | 1 | 1 | 0 | 0 | 0 | 0 | 0 | 0 | 1 | 0 | 0 | 0 | 0 | 0 | □ | ◎ | ○ | ○ | ○ | ○ | ○ | ○ | ● | | | | | | $55+\alpha$ |
| 11TH | 1010 | 1 | 1 | 0 | 0 | 0 | 0 | 0 | 0 | 0 | 1 | 0 | 0 | 0 | 0 | □ | ◎ | ○ | ○ | ○ | ○ | ○ | ○ | ○ | ● | | | | | $77+\alpha$ |
| 12TH | 1011 | 1 | 1 | 0 | 0 | 0 | 0 | 0 | 0 | 0 | 0 | 1 | 0 | 0 | 0 | □ | ◎ | ○ | ○ | ○ | ○ | ○ | ○ | ○ | ○ | ● | | | | $103+\alpha$ |
| 13TH | 1100 | 1 | 1 | 0 | 0 | 0 | 0 | 0 | 0 | 0 | 0 | 0 | 1 | 0 | 0 | □ | ◎ | ○ | ○ | ○ | ○ | ○ | ○ | ○ | ○ | ○ | ● | | | $133+\alpha$ |
| 14TH | 1101 | 1 | 1 | 0 | 0 | 0 | 0 | 0 | 0 | 0 | 0 | 0 | 0 | 1 | 0 | □ | ◎ | ○ | ○ | ○ | ○ | ○ | ○ | ○ | ○ | ○ | ○ | ● | | $169+\alpha$ |
| 15TH | 1110 | 1 | 1 | 0 | 0 | 0 | 0 | 0 | 0 | 0 | 0 | 0 | 0 | 0 | 1 | □ | ◎ | ○ | ○ | ○ | ○ | ○ | ○ | ○ | ○ | ○ | ○ | ○ | ● | $209+\alpha$ |
| 16TH | 1111 | 1 | 1 | 0 | 0 | 0 | 0 | 0 | 0 | 0 | 0 | 0 | 0 | 0 | 0 | □ | ◎ | ○ | ○ | ○ | ○ | ○ | ○ | ○ | ○ | ○ | ○ | ○ | ○ | $255+\alpha$ |

□ WRITE ADDRESSING DISCHARGE + WEAK LIGHT EMISSION DISCHARGE

○ SUSTAIN DISCHARGE LIGHT EMISSION

◎ WRITE ADDRESSING DISCHARGE + SUSTAIN DISCHARGE LIGHT EMISSION

● ERASURE ADDRESSING DISCHARGE $\alpha < 1$

FIG. 6

| ACCUMULATED RUNNING TIME (RT) | | BLACK DISPLAY CELL COUNT (SN) | | |
|---|---|---|---|---|
| | | SN<b | b≦SN<c | c≦SN |
| | 0≦RT<A | $L_5$ | $L_3$ | $L_1$ |
| | A≦RT<B | $L_5$ | $L_4$ | $L_2$ |
| | B≦RT<C | $L_5$ | $L_5$ | $L_3$ |
| | C≦RT | $L_5$ | $L_5$ | $L_5$ |

$$L_1 < L_2 < L_3 < L_4 < L_5$$

METHOD FOR DRIVING PLASMA DISPLAY PANEL

BACKGROUND OF THE INVENTION

1. Field of the Invention

The present invention relates to a method for driving a plasma display panel.

2. Description of the Related Art

Currently, an AC (discharge)-type plasma display panel (PDP) is commercially available as a thin display device. In a PDP, two substrates (i.e., a front transparent substrate and a rear substrate) are disposed opposite each other with a predetermined interval therebetween. Pairs of row electrodes extending in a horizontal direction of the screen are formed on an inner surface of the front transparent substrate as a display surface. The inner surface of the front transparent substrate faces the rear substrate. A dielectric layer is formed on the inner surface of the front transparent substrate such that the dielectric layer covers the pairs of row electrodes. Column electrodes extending in a vertical direction of the screen are formed on the rear substrate such that the column electrodes cross the pairs of row electrodes. When viewed from the front (i.e., from the display surface side), discharge cells, which serve as pixels, are formed at intersections of the row electrode pairs and the column electrodes.

Grayscale driving is performed on such a PDP using a subfield scheme to achieve halftone display luminance faithful to an input image signal.

In such a grayscale drive method based on the subfield scheme, each field (unit display period) is divided into a plurality of subfields and a certain number of times (or a period during which) light emission is to be performed is allocated to each subfield. Display driving of an image signal for one field is performed on the subfield basis. An addressing process and a sustain process are sequentially performed in each subfield. In the addressing process, an addressing discharge is selectively generated between a row electrode and a column electrode in each discharge cell on the basis of an input image signal. A certain amount of wall charges are generated (or erased) in those discharge cells in which the addressing discharge has been generated. In other discharge cells in which no addressing discharge has been generated, the state of wall charges is maintained unchanged from the immediately previous state. Discharge cells having a specific amount of wall charges are set to an emission mode and other discharge cells having no specific amount of wall charges are set to a non-emission mode. In the sustain process, a discharge is repeatedly generated a number of times corresponding to a luminance weight value allocated to the subfield in those discharge cells that are in the emission mode, thereby maintaining light emission through the discharge. In the first subfield, an initialization process is performed prior to the addressing process. In the initialization process, a reset pulse is simultaneously applied to every discharge cell, thereby causing a reset discharge between row electrodes in every discharge cell. This initializes the amount of wall charges remaining in every discharge cell.

Since the reset discharge is a relatively strong discharge and contributes nothing to the contents of an image to be displayed, light emission caused by this discharge leads to a reduction in image contrast, especially a reduction in dark contrast when an entirely dark image is displayed.

In one suggested drive method, the dark contrast is increased by decreasing the peak potential of the reset pulse to weaken the reset discharge as the darkness of an image to be displayed increases (i.e., as the number of those discharge cells that are in a non-emission mode in one screen increases). See FIG. 8 of Japanese Patent Application Kokai (Publication) No. 2006-243002.

However, reducing the peak potential of the reset pulse may lead to generation of an insufficient amount of wall charges due to weakening of the reset discharge. In this case, erroneous discharges occur in the subsequent sustain process.

SUMMARY OF THE INVENTION

One object of the present invention is to provide a method for driving a plasma display panel (PDP) that can increase dark contrast without causing erroneous discharges.

According to a first aspect of the present invention, there is provided a method for driving a plasma display panel based on pixel data of pixels derived from an image signal. The plasma display panel includes a first substrate, a second substrate, a plurality of row electrode pairs disposed on the first substrate and a plurality of column electrodes disposed on the second substrate. The first substrate may be spaced from the second substrate to define discharge spaces therebetween. Discharge gases may be sealed in the discharge spaces. Discharge cells are formed respectively at intersections of the row electrode pairs with the column electrodes. A unit display period is divided into a plurality of subfields. The method includes an addressing process, in which each of the discharge cells is set to either an emission mode or a non-emission mode, in each subfield. The method also includes a sustain process for applying a sustain pulse in each subfield. In the sustain process, the sustain discharge may be repeatedly generated a number of times, corresponding to a number of times a sustain pulse is applied, in each subfield. The sustain discharge may be generated in those discharge cells which are in the emission mode. The method also includes a reset process, in which a reset pulse is applied to one of two row electrodes in each row electrode pair prior to the addressing process so as to initialize each of the discharge cells. The reset pulse takes place in one of the subfields in the unit display period. A peak potential of the reset pulse is altered based on a number of those discharge cells which are maintained in the non-emission mode during the unit display period and/or the number of times the sustain pulse is to be applied in the sustain process in said one subfield.

According to a second aspect of the present invention, there is provided another method for driving a plasma display panel based on pixel data of pixels derived from an image signal. The plasma display panel includes first and second substrates disposed opposite each other. Discharge spaces may be formed between the first and second substrates. Discharge gases may be sealed in the discharge spaces. The plasma display panel also includes a plurality of row electrode pairs provided on the first substrate and a plurality of column electrodes provided on the second substrate. Discharge cells are formed respectively at intersections of the row electrode pairs with the column electrodes. A unit display period is divided into a plurality of subfields. The method includes an addressing process for setting each of the discharge cells to an emission mode or a non-emission mode in each subfield. In the addressing process, an addressing discharge may be generated in each of the discharge cells. The method also includes a sustain process for applying a sustain pulse in each subfield. In the sustain process, a sustain discharge may be repeatedly generated a number of times, corresponding to a number of times a sustain pulse is applied, in those discharge cells that are in the emission mode. The method also includes a reset process, in which a reset pulse is applied to one of two row electrodes in each row electrode pair prior to the addressing process to initialize each of the discharge cells. The reset process takes place in one of the subfields in the unit display period. A peak potential of the reset pulse is changed based on the number of times the sustain pulse is to be applied in the sustain process in said one subfield.

According to a third aspect of the present invention, there is provided still another method for driving a plasma display panel based on pixel data of pixels derived from an image signal. The plasma display panel includes first and second substrates disposed opposite each other. Discharge spaces may be formed between the first and second substrates. The plasma display panel also includes a plurality of row electrode pairs on the first substrate and a plurality of column electrodes on the second substrate. Discharge gases may be sealed in the discharge spaces. Discharge cells are formed respectively at intersections of the row electrode pairs with the column electrodes. A unit display period is divided into a plurality of subfields. The method includes an addressing process in each subfield. In the addressing process, each of the discharge cells is set to one of an emission mode and a non-emission mode. The method also includes a sustain process for applying a sustain pulse in each subfield. In the sustain process, a sustain discharge may be repeatedly generated a number of times, corresponding to a number of times a sustain pulse is applied, in those discharge cells that are in the emission mode. The method also includes a reset process, in which a reset pulse is applied to one of two row electrodes in each row electrode pair prior to the addressing process to initialize each of the discharge cells. The reset process takes place in one of the subfields in the unit display period. The reset process includes a front half process in which a first reset pulse having a positive peak potential is applied to said one of the two row electrodes and a rear half process in which a second reset pulse having a negative peak potential is applied to the same one of the two row electrodes subsequently to the front half process. The negative peak potential of the second reset pulse is changed based on a number of those discharge cells that are maintained in the non-emission mode during a unit display period in which the second reset pulse is applied.

The reset process and sustain process are performed in one subfield of the unit display period. In the reset process, a reset pulse is applied to row electrodes of the plasma display panel to initialize each discharge cell to either an emission mode or a non-emission mode. In the sustain process, a sustain discharge is repeatedly generated a number of times, corresponding to the number of times a sustain pulse is to be applied, in those discharge cells that are in the emission mode. A peak potential of the reset pulse is adjusted in accordance with the number of discharge cells that are maintained in the non-emission mode during the unit display period and the number of times the sustain pulse is to be applied in the sustain process in said one subfield.

The absolute value of the peak potential of the reset pulse decreases as the number of discharge cells that are maintained in the non-emission mode during the unit display period increases (i.e., as the overall darkness of an image to be displayed increases). As a result, the luminance of light emitted through the reset discharge drops, thereby achieving an increase in the dark contrast. When the number of times the sustain pulse is to be applied in the sustain process is less than a predetermined number, the absolute value of the peak potential of the reset pulse is set to be smaller than when the number of times the sustain pulse is to be applied is equal to or greater than the predetermined number. According to this drive method, when the number of times the sustain pulse is applied is large, a strong(er) reset discharge is generated, compared to when the number of times the sustain pulse is applied is small, thereby making it possible to initialize the amount of wall charges generated in the discharge cells to a desired amount. Consequently, an erroneous sustain discharge can be prevented even if the number of sustain pulse applications is large, while improving (enhancing) a dark contrast.

BRIEF DESCRIPTION OF THE DRAWINGS

The above and other objects, aspects, features and advantages of the present invention will be more clearly understood from the following detailed description taken in conjunction with the accompanying drawings, in which:

FIG. 3 illustrates light emission patterns of respective gray levels;

FIG. 6 illustrates an example operation of a peak potential setting unit for setting a negative peak potential of a second reset pulse;

DETAILED DESCRIPTION OF THE INVENTION

Figure 1:
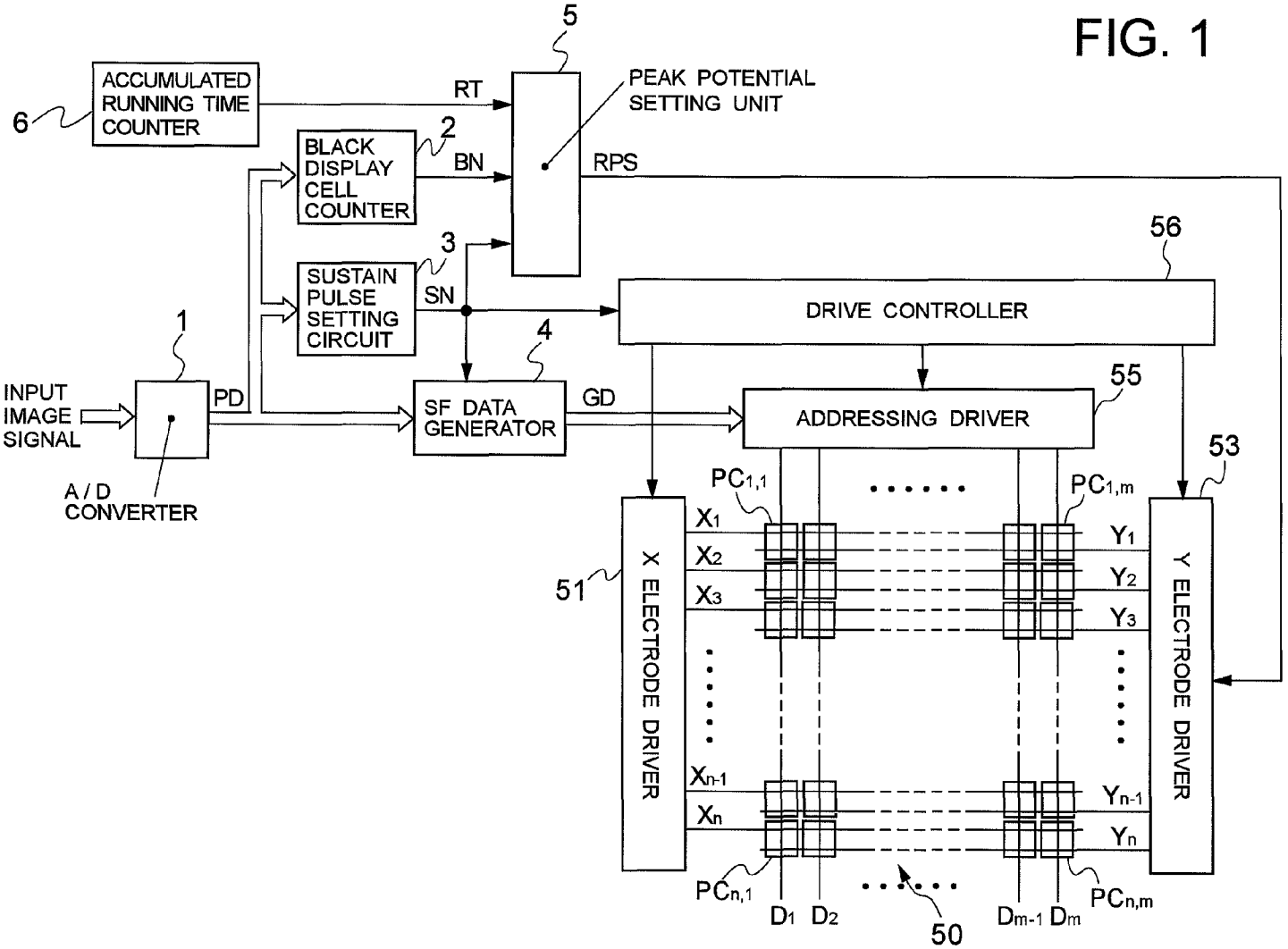
FIG. 1 illustrates a schematic configuration of a plasma display device according to one embodiment of the invention.

Referring to FIG. 1, a configuration of a plasma display device that drives a plasma display panel (PDP) using a drive method according to a first embodiment of the invention will be described.

As shown in FIG. 1, the plasma display device includes a PDP 50 and a drive unit that drives the PDP 50 according to input image signals. Details of the drive unit are described below.

The PDP 50 includes a front substrate (not shown) serving as a display surface and a rear substrate (not shown) that is disposed opposite the front substrate with discharge gases being sealed in a discharge space defined between the front and rear substrates. Row electrodes $X_1$ to $X_n$ and row electrodes $Y_1$ to $Y_n$ are alternately arranged in parallel to each other on the front substrate. Column electrodes $D_1$ to $D_m$ are arranged, crossing the row electrodes, on the rear substrate. A row electrode Xi and a neighboring electrode Yi make a pair to serve as a display line so that n pairs of row electrodes ($X_1$ and $Y_1$, $X_2$ and $Y_2$, . . . and $X_n$ and $Y_n$) serve as 1st to nth display lines of the PDP 50, respectively. Discharge cells (or display cells) PC, each serving as a pixel, are formed in respective intersection portions (each having a discharge space) between the pairs of row electrodes and the column electrodes. That is, n×m discharge cells $PC_{1,1}$ to $PC_{n,m}$ are arranged in a matrix in a screen of the PDP 50.

An A/D converter 1 converts a luminance level of each discharge cell PC of an input image signal into pixel data PD, for example represented in 8 bits, and supplies the 8-bit pixel data PD to a black display cell counter 2, a sustain pulse count setting unit 3, and a subfield (SF) data generator 4.

Based on an input image signal, the black display cell counter 2 counts the number of those discharge cells PC that are maintained in a black display state (i.e., a luminance level of 0) over a display period of each frame (or field). In the following description, the display period of each frame is referred to as a unit display period. The black display cell counter 2 supplies a black display cell count signal BN indicating the counted number of discharge cells PC that are maintained in a black display state to a peak potential setting unit 5.

Figure 2:
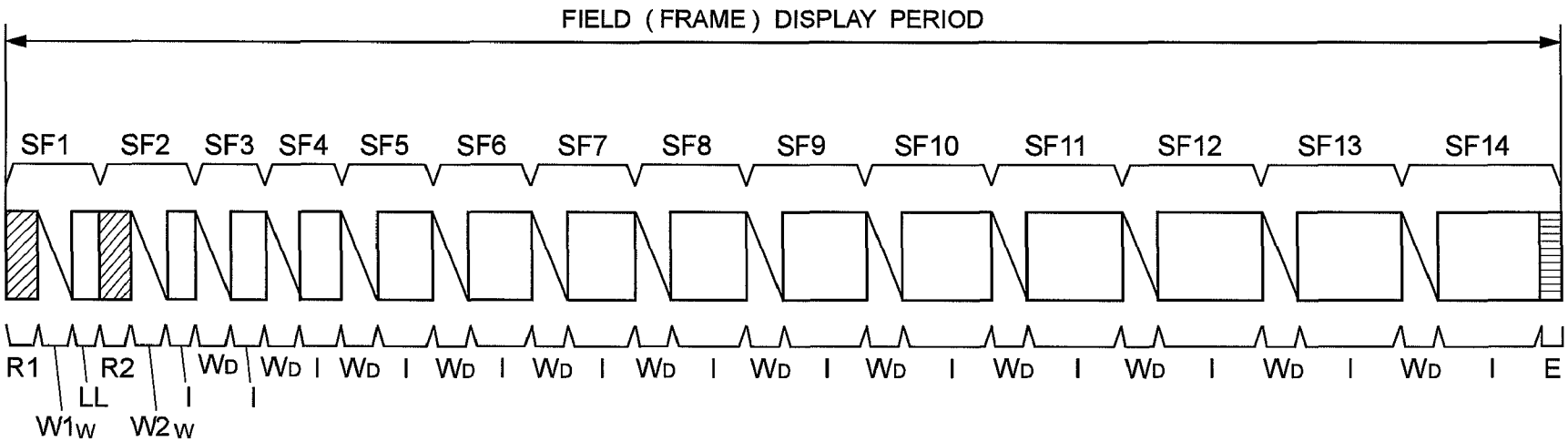
FIG. 2 illustrates an example light emission drive sequence employed in the plasma display device shown in FIG. 1.

Based on an input image signal, the sustain pulse count setting unit 3 determines the number of sustain pulses to be allocated to each of subfields SF1 to SF14, as shown in FIG. 2, of each frame (or field). For example, based on an average luminance level of each frame (or field) represented by the input image signal, the sustain pulse count setting unit 3 determines the number of sustain pulses to be allocated to each subfield SF in the frame. The number of sustain pulses allocated to each subfield SF may be adjusted according to temperature of the PDP 50. Respective luminance weight values are allocated in advance to the subfields SF1 to SF14 such that the luminance weight values allocated to the subfields sequentially increase in the order of the subfields. The sustain pulse count setting unit 3 determines the number of sustain pulses to be allocated to each subfield SF according to the luminance weight allocated to the subfield SF. The sustain pulse count setting unit 3 supplies a sustain pulse count signal SN, indicating the number of sustain pulses of each subfield SF determined in this manner, to the subfield data generator 4, the peak potential setting unit 5, and a drive controller 56.

An accumulated running time counter 6 measures the sum of periods (i.e., an accumulated running time) during which power has been supplied to the plasma display device since the plasma display device has been shipped from a manufacturer (factory) and supplies an accumulated running time signal RT indicating the accumulated running time to the peak potential setting unit 5.

The peak potential setting unit 5 determines a negative peak potential PV, which will be used as a negative peak potential of a reset pulse $RP2_{Y2}$ (described below), based on the accumulated running time signal RT, the sustain pulse count signal SN, and a black display cell count signal BN, and supplies a peak potential setting signal RPS indicating the negative peak potential PV to a Y electrode driver 53. The peak potential setting unit 5 uses a sustain pulse count signal SN and a black display cell count signal BN of the same frame (field) when determining the negative peak potential PV.

The subfield data generator 4 applies a grayscale conversion process including an error diffusion process and/or a dithering process on each pixel data PD of each discharge cell PC received from the A/D converter 1 to convert the pixel data into 4-bit grayscale pixel data PDs which represents an entire luminance range of the input image signal in 16 gray levels (first to sixteenth gray levels) as shown in FIG. 3. The subfield data generator 4 changes a pattern of the grayscale pixel data PDs based on the number of sustain pulses of each subfield SF indicated by the sustain pulse count signal SN. The drive controller 56 converts the grayscale pixel data PDs into 14-bit subfield data GD according to a data conversion table as shown in FIG. 3 and sequentially supplies the 14-bit subfield data GD to an addressing driver 55. Each bit position of the subfield data GD represents setting (emission mode or non-emission mode) of a discharge cell PC in a subfield SF corresponding to the bit position (e.g., the first bit position corresponds to the first subfield).

The drive controller 56 supplies various control signals to the X electrode driver 51, the Y electrode driver 53, and the addressing driver 55. The X electrode driver 51, the Y electrode driver 53, and the addressing driver 55 are collectively referred to as a panel driver. The control signals are used to drive the PDP 50 according to a light emission drive sequence as shown in FIG. 2. More specifically, the drive controller 56 provides the panel driver with control signals for causing the panel driver to sequentially drive the PDP 50 according to a first reset process R1, a first selective write addressing process $W1_W$, and a weak light emission process LL in a first subfield SF1 in a unit display period as shown in FIG. 2. Then, the drive controller 56 provides the panel driver with control signals for causing the panel driver to sequentially drive the PDP 50 according to a second reset process R2, a second selective write addressing process $W2_W$, and a sustain process I in a second subfield SF2 subsequent to the first subfield SF1. Then, the drive controller 56 provides the panel driver with control signals for causing the panel driver to sequentially drive the PDP 50 according to a selective erasure addressing process $W_D$ and a sustain process I in each of the third to fourteenth subfields SF3 to SF14. The drive controller 56 also provides the panel driver with control signals for causing the panel driver to sequentially drive the PDP 50 according to an erasure process E after the sustain process I only in the last subfield SF14 in the display period of one field.

In the sustain process I of each subfield SF, the drive controller 56 provides the panel driver with a control signal for causing the panel driver to repeatedly apply a sustain pulse IP (described below) the same number of times as the number of sustain pulses indicated by the sustain pulse count signal SN.

Figure 4:
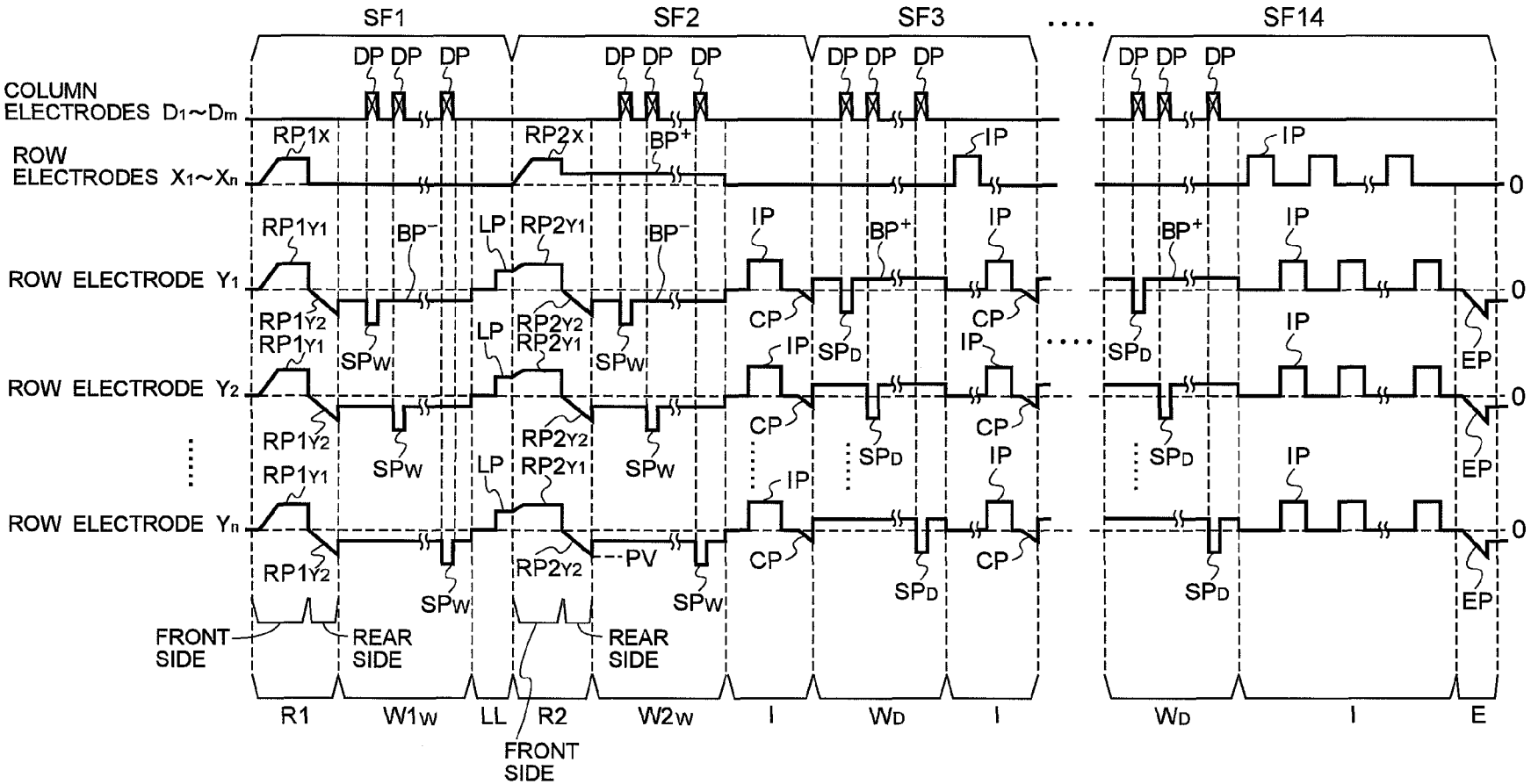
FIG. 4 illustrates a first pulse sequence of various drive pulses to be applied to a PDP according to the light emission drive sequence shown in FIG. 2.
Figure 5:
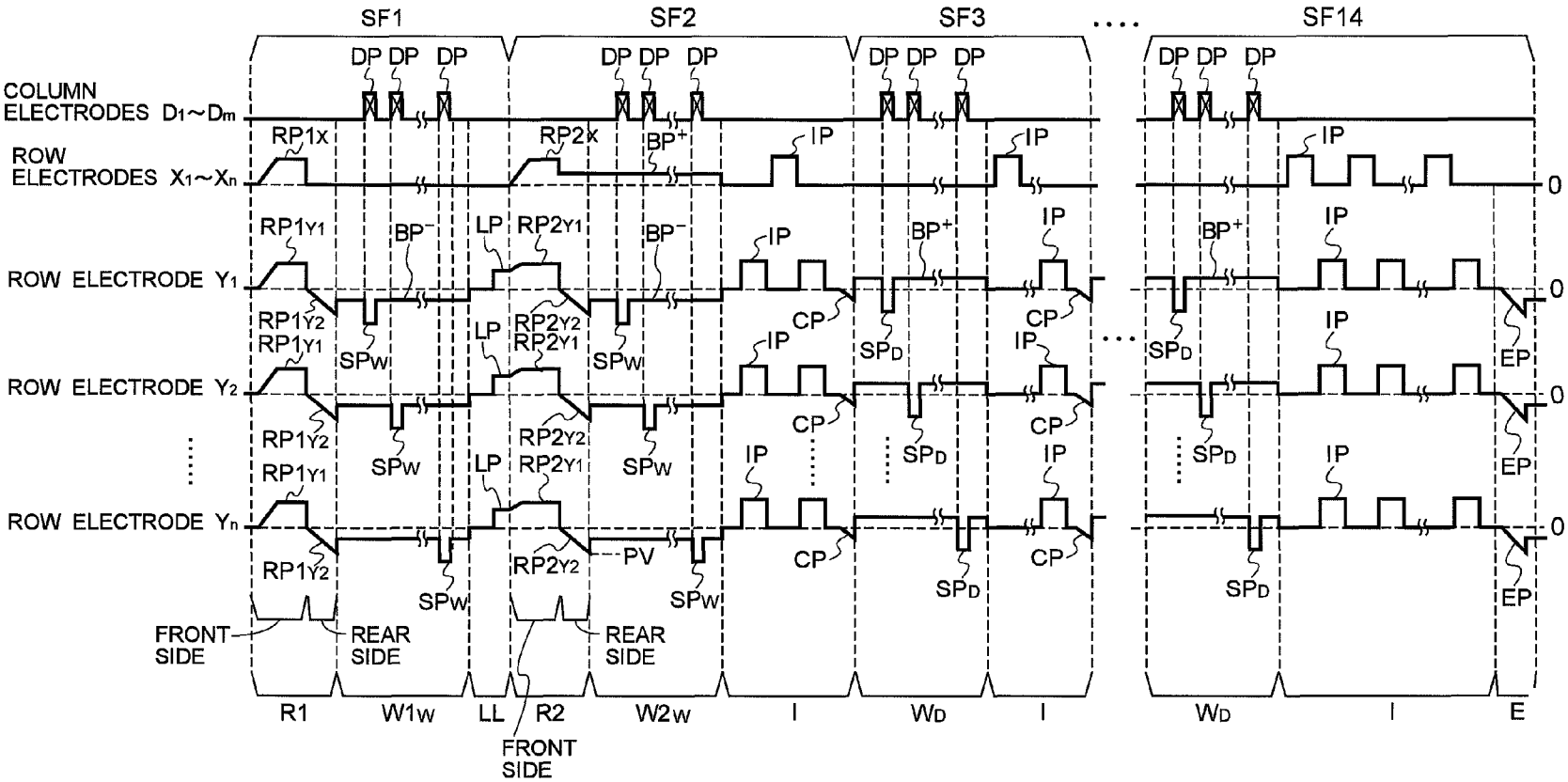
FIG. 5 illustrates a second pulse sequence of various drive pulses to be applied to the PDP according to the light emission drive sequence shown in FIG. 2.

Upon receiving the control signals from the drive controller 56, the panel driver, which includes the X electrode driver 51, the Y electrode driver 53, and the addressing driver 55, applies various drive pulses to the column electrodes D and the row electrodes X and Y of the PDP 50, for example according to a first pulse sequence shown in FIG. 4 or a second pulse sequence shown in FIG. 5. The first pulse sequence of FIG. 4 illustrates the manner in which drive pulses are applied when the number of sustain pulses in the subfield SF2 indicated by the sustain pulse count signal SN is "1." On the other hand, the second pulse sequence of FIG. 5 illustrates the manner in which drive pulses are applied when the number of sustain pulses in the subfield SF2 indicated by the sustain pulse count signal SN is "3."

The manner in which drive pulses are applied in the first pulse sequence shown in FIG. 4 and the manner in which drive pulses are applied in the second pulse sequence shown in FIG. 5 are the same with the only difference being the number of sustain pulses IP that are repeatedly applied in the sustain process I of each subfield SF. How the panel driver operates to apply drive pulses will now be described with reference to FIG. 4.

First, in a front side of a first reset process R1 of a subfield SF1, the Y electrode driver 53 applies a positive reset pulse $RP1_{Y1}$, to all the row electrodes $Y_1$ to $Y_n$. The reset pulse $RP1_{Y1}$ has a pulse waveform that slowly changes in potential in a leading edge portion thereof, as compared with a sustain pulse IP (described below). During this pulse application, the addressing driver 55 sets the column electrodes $D_1$ to $D_m$ to ground potential (i.e., 0V). Upon application of the reset pulse $RP1_{Y1}$ to the row electrodes $Y_1$ to $Y_n$, a first reset discharge occurs between the row electrode Y and column electrode D of every the discharge cell PC. That is, in the front side of the first reset process R1, predetermined voltages are applied between the row and column electrodes Y and D to bring the row electrodes Y and the column electrodes D into positive and negative potentials, respectively, thereby reducing a particular discharge (first reset discharge). This first reset discharge causes a current to flow from the row electrodes Y to the column electrodes D and is hereinafter referred to as a "column-side negative (cathode) discharge". The first reset discharge occurring in this manner generates negative wall charges near the row electrodes Y and positive wall charges near the column electrodes D in all the discharge cells PC. In addition, in the front side of the first reset process R1, the X electrode driver 51 applies a reset pulse RP1$x$ to each of the row electrodes $X_1$ to $X_n$. The reset pulse RP1$x$ has the same polarity (positive polarity) as that of the reset pulse $RP\mathbf{1}_{Y1}$. The reset pulse RP1X has a peak potential that can prevent surface discharge, which would otherwise occur between the row electrodes X and Y upon application of the reset pulse $RP\mathbf{1}_{Y1}$.

Subsequently, in the rear side of the first reset process R1 of the subfield SF1, the Y electrode driver 53 generates a reset pulse $RP\mathbf{1}_{Y2}$, which has a pulse waveform that slowly decreases down to a negative peak potential as shown in FIG. 4, and applies the reset pulse $RP\mathbf{1}_{Y2}$ to all the row electrodes $Y_1$ to $Y_n$. As the reset pulse $RP\mathbf{1}_{Y2}$ is applied to the row electrodes $Y_1$ to $Y_n$, a second reset discharge occurs between the row electrodes X and Y of all the discharge cells PC. The negative peak potential of the reset pulse $RP\mathbf{1}_{Y2}$ is set such that the magnitude of the negative peak potential (bottom potential) is the smallest that can guarantee the second reset discharge between the row electrodes X and Y in consideration of wall charges generated near the row electrodes X and Y through the first reset discharge. The negative peak potential of the reset pulse $RP\mathbf{1}_{Y2}$ is also set to be higher than the negative peak potential of a write scan pulse $SP_W$ (described below), i.e., set to a level near 0V. If the negative peak potential of the reset pulse $RP\mathbf{1}_{Y2}$ is lower than that of the write scan pulse $SP_W$, a strong discharge occurs between the row electrodes Y and the column electrodes D so that a significant amount of wall charges generated near the column electrodes D is erased. This results in unstable addressing discharge in a first selective write addressing process $W\mathbf{1}_W$ (described below).

The second reset discharge occurring in the rear side of the first reset process R1 erases wall charges that have been generated near each of the row electrodes X and Y in each discharge cell PC, thereby initializing every discharge cell PC to a non-emission mode. As the reset pulse $RP\mathbf{1}_{Y2}$ is applied, a weak discharge also occurs between the row electrodes Y and the column electrodes D in all the discharge cells PC. This weak discharge erases some of positive wall charges generated near the column electrodes D, thereby adjusting the amount of the positive wall charges to a level that can guarantee a selective write addressing discharge in the first selective write addressing process $W\mathbf{1}_W$.

Subsequently, in the first selective write addressing process $W\mathbf{1}_W$ of the subfield SF1, the Y electrode driver 53 simultaneously applies a base pulse $BP^-$ having a specific negative potential to the row electrodes $Y_1$ to $Y_n$ while sequentially applying a write scan pulse $SP_W$ having a negative peak potential to each of the row electrodes $Y_1$ to $Y_n$ as shown in FIG. 4. During this process, the X electrode driver 51 keeps applying a voltage of 0V to each of the row electrodes $X_1$ to $X_n$. In addition, in the first selective write addressing process $W\mathbf{1}_W$, the addressing driver 55 generates a pixel data pulse DP according to a logic level of a bit (e.g., the first bit) corresponding to the subfield SF1 in the subfield data GD. For example, the addressing driver 55 generates a pixel data pulse DP having a positive peak potential when the first bit of the subfield data GD is at a logic level of "1" for setting the discharge cell PC to an emission mode. On the other hand, the addressing driver 55 generates a low-voltage (i.e., 0V) pixel data pulse DP when the first bit of the subfield data GD is at a logic level of "0" for setting the discharge cell PC to a non-emission mode. The addressing driver 55 sequentially applies such pixel data pulses DP display-line-by-display-line (i.e., m pixel data pulses DP at a time) to the column electrodes $D_1$ to $D_m$ in synchronization with application of write scan pulses $SP_W$. When the write scan pulse $SP_W$ is applied, a selective write addressing discharge occurs between a column electrode D and a row electrode Y in each of those discharge cells PC to which a high-voltage pixel data pulse DP has been applied. This selective write addressing discharge switches such discharge cells PC to an emission mode, i.e., a state in which positive wall charges are generated near the row electrode Y and negative wall charges are generated near the column electrode D. On the other hand, when the write scan pulse $SP_W$ is applied, no selective write addressing discharge occurs between a column electrode D and a row electrode Y in those discharge cells PC to which a low-voltage (0V) pixel data pulse DP for setting to a non-emission mode is applied. Thus, these discharge cells PC are kept in the immediately previous state, i.e., the non-emission mode. The discharge cells have been initialized to the non-emission mode in the first reset process R1.

In the weak light emission process LL of the subfield SF1, the Y electrode driver 53 simultaneously applies a weak light emission pulse LP having a specific positive peak potential to the row electrodes $Y_1$ to $Y_n$ as shown in FIG. 4. As the weak light emission pulse LP is applied in this manner, a discharge, which is hereinafter referred to as a "weak light emission discharge," occurs between a row electrode Y and a column electrode D in each of those discharge cells PC that have been set to an emission mode. That is, in the weak light emission process LL, a specific voltage is applied to the row electrodes Y to cause a discharge between the row electrodes Y and the column electrodes D of the discharge cells PC while causing no discharge between the row electrodes X and Y, so that a weak light emission discharge occurs only between column electrodes D and row electrodes Y of those discharge cells PC that have been set to an emission mode. When the weak light emission discharge has occurred, negative wall charges are generated near the row electrodes Y and positive wall charges are generated near the column electrodes D.

The potential change rate in a rising edge portion of the weak light emission pulse LP is faster than that in a rising edge portion of each of the reset pulses $RP\mathbf{1}_{Y1}$ and $RP\mathbf{2}_{Y1}$. That is, the potential change rate of a leading edge portion of the weak light emission pulse LP is faster than the potential change rate of a leading edge portion of the reset pulse, so that the intensity of a discharge that occurs in the weak light emission process LL is greater than the first reset discharge that occurs in the first reset process R1. The luminance of light emitted through such a discharge is lower than that of the sustain discharge that occurs between the row electrodes X and Y since the discharge is the above-described column-side negative (cathode) discharge and is caused by a weak light emission pulse LP having a lower peak potential than that of the sustain pulse IP. That is, in the weak light emission process LL, a discharge that is accompanied by light emission at a luminance level higher than the first reset discharge and lower than the sustain discharge (i.e., a discharge that is accompanied by weak light emission at a luminance level usable for display) occurs as a weak light emission discharge. In the first selective write addressing process $W1_W$ performed immediately before the weak light emission process LL, a selective write addressing discharge occurs between the column and row electrodes D and Y in the discharge cells PC. Accordingly, in the subfield SF1, luminance of a gray level corresponding to a luminance level that is one level higher than a luminance level of "0" is expressed due to both light emission that is caused by the selective write addressing discharge and light emission that is caused by the weak light emission discharge.

Next, in a front side of a second reset process R2 of the subfield SF2, the Y electrode driver 53 applies a positive reset pulse $RP2_{Y1}$, which has a pulse waveform that slowly changes in potential in a leading edge portion thereof, if compared with the sustain pulse IP, to all the row electrodes $Y_1$ to $Y_n$. During this process, the addressing driver 55 sets the column electrodes $D_1$ to $D_m$ to ground (i.e., 0V) and the X electrode driver 51 applies a reset pulse RP2*x* having a positive peak potential to each of the row electrodes $X_1$ to $X_n$. The reset pulse RP2*x* can prevent surface discharge that would otherwise occur between the row electrodes X and Y upon application of the reset pulse $RP2_{Y1}$. Although the positive peak potential of the reset pulse $RP2_X$ is lower than the positive peak potential of the sustain pulse IP, the X electrode driver 51 may set all the row electrodes $X_1$ to $X_n$ to ground (i.e., 0V), instead of applying the reset pulse RP2*x* to the row electrodes $X_1$ to $X_n$, if setting to ground does not cause a surface discharge between the row electrodes X and Y. As the reset pulse $RP2_{Y1}$ is applied to the row electrodes $Y_1$ to $Y_n$, a first reset discharge, which is weaker than the column-side negative (cathode) discharge in the weak light emission process LL, occurs between the row and column electrodes Y and D in those discharge cells PC in which column-side negative (cathode) discharge did not occur in the weak light emission process LL.

That is, in the front side of the second reset process R2, specific voltages are applied between the row and column electrodes Y and D to bring the row electrodes Y and the column electrodes D into positive and negative potentials, respectively, thereby inducing a column-side negative (cathode) discharge with current flowing from the row electrodes Y to the column electrodes D as the first reset discharge. On the other hand, even though the reset pulse $RP2_{Y1}$ is applied, no discharge occurs in those discharge cells PC in which the weak light emission discharge takes place in the weak light emission process LL. Accordingly, immediately after the front side of the second reset process R2 is finished, all the discharge cells PC are in a state in which negative wall charges are generated near the row electrodes Y and positive wall charges are generated near the column electrodes D.

In the rear side of the second reset process R2 of the subfield SF2, the Y electrode driver 53 applies a reset pulse $RP2_{Y2}$ to all the row electrodes $Y_1$ to $Y_n$. The reset pulse $RP2_{Y2}$ has a pulse waveform that slowly decreases down to a negative peak potential PV indicated by the peak potential setting signal RPS as shown in FIG. 4. In addition, in the rear side of the second reset process R2, the X electrode driver 51 simultaneously applies a base pulse $BP^+$ having a predetermined positive potential to each of the row electrodes $X_1$ to $X_n$. As the negative reset pulse $RP2_{Y2}$ and the positive base pulse $BP^+$ are applied, a second reset discharge occurs between the row electrodes X and Y in all the discharge cells PC. The respective peak potentials of the reset pulse $RP2_{Y2}$ and the base pulse $BP^+$ are set such that the magnitude of each of the two peak potentials is the smallest that can guarantee the second reset discharge between the row electrodes X and Y in consideration of wall charges generated near the row electrodes X and Y through the first reset discharge. The second reset discharge occurring in the rear side of the second reset process R2 erases wall charges that have been generated near each of the row electrodes X and Y in each discharge cell PC, thereby initializing every discharge cell PC to a non-emission mode. Upon application of the reset pulse $RP2_{Y2}$, a weak discharge also occurs between the row electrodes Y and the column electrodes D in all the discharge cells PC. This weak discharge erases some of positive wall charges generated near the column electrodes D, thereby adjusting the amount of the positive wall charges to a level that can guarantee a selective write addressing discharge in the second selective write addressing process $W2_W$.

In the second selective write addressing process $W2_W$ of the subfield SF2, the Y electrode driver 53 simultaneously applies a base pulse $BP^-$ having a specific negative potential to the row electrodes $Y_1$ to $Y_n$ while sequentially applying a write scan pulse $SP_W$ having a negative peak potential to each of the row electrodes $Y_1$ to $Y_n$ as shown in FIG. 4. During this process, the X electrode driver 51 applies a base pulse $BP^+$ having a specific positive potential to each of the row electrodes $X_1$ to $X_n$. In addition, in the second selective write addressing process $W2_W$, the addressing driver 55 generates a pixel data pulse DP according to a logic level of a bit (for example, the second bit) corresponding to the subfield SF2 in the subfield data GD. For example, the addressing driver 55 generates a pixel data pulse DP having a positive peak potential when the second bit of the subfield data GD is at a logic level of "1" for setting the discharge cell PC to an emission mode. On the other hand, the addressing driver 55 generates a low-voltage (i.e., 0V) pixel data pulse DP when the second bit of the subfield data GD is at a logic level of "0" for setting the discharge cell PC to a non-emission mode. The addressing driver 55 sequentially applies such pixel data pulses DP one-display-line-by-one-display-line (i.e., m pixel data pulses DP at a time) to the column electrodes $D_1$ to $D_m$ in synchronization with application of write scan pulses $SP_W$. Upon application of the write scan pulse $SP_W$, a selective write addressing discharge occurs between a column electrode D and a row electrode Y in those discharge cells PC to which a high-voltage pixel data pulse DP is applied. This selective write addressing discharge switches these discharge cells PC to an emission mode, i.e., a state in which positive wall charges are generated near the row electrode Y and negative wall charges are generated near the column electrode D. On the other hand, when the write scan pulse $SP_W$ is applied, no selective write addressing discharge occurs between a column electrode D and a row electrode Y in those discharge cells PC to which a low-voltage (0V) pixel data pulse DP for setting to a non-emission mode is applied. Thus, these discharge cells PC are kept in the immediately previous state, i.e., the emission or non-emission mode.

In the sustain process I of each of the subfields SF2 to SF14, the X electrode driver 51 and the Y electrode driver 53 repeatedly and alternately apply a sustain pulse IP having a positive peak potential to the group of row electrodes $X_1$ to $X_n$ and the group of row electrodes $Y_1$ to $Y_n$. The number of sustain pulses IP repeatedly applied in the sustain process I of each of the subfields SF2 to SF14 is decided based on the number of sustain pulses of each subfield SF indicated by the sustain pulse count signal SN. For example, when the number of sustain pulses of the subfield SF2 indicated by the sustain pulse count signal SN is "1," only the Y electrode driver 53 among the X and Y electrode drivers 51 and 53 applies only one sustain pulse IP to the Y row electrode group in the sustain process I of the subfield SF2 as shown in FIG. 4. When the number of sustain pulses of the subfield SF2 indicated by the sustain pulse count signal SN is "3," the X electrode driver 51 and the Y electrode driver 53 alternately apply a total of three sustain pulses IP to the X row electrode group and the Y row electrode group in the sustain process I of the subfield SF2 as shown in FIG. 4.

In the sustain process I, a sustain discharge occurs between row electrodes X and Y in those discharge cells PC that have been set to an emission mode each time the sustain pulse IP is applied. As the sustain discharge occurs, a fluorescent layer 17 emits light, which is then emitted from the PDP 50 through the front transparent substrate 10. Accordingly, the luminance of light viewed is determined according to the number to times the sustain discharge is repeated. As the sustain pulse IP is applied, a discharge also occurs between row electrodes Y and column electrodes D of those discharge cells PC that have been set to an emission mode. As this discharge and the sustain discharge occur, negative wall charges are generated near the row electrodes Y in the discharge cells PC and positive wall charges are generated near the row electrodes X and the column electrodes D in the discharge cells PC.

Immediately after the final sustain pulse IP is applied in the sustain process I of each of the subfields SF2 to SF14, the Y electrode driver 53 applies a wall charge adjustment pulse CP to the row electrodes $Y_1$ to $Y_n$. The wall charge adjustment pulse CP has a pulse waveform that slowly decreases down to a negative peak potential in a leading edge portion thereof as shown in FIG. 4. Upon application of this wall charge adjustment pulse CP, a weak erasure discharge occurs in those discharge cells PC in which the sustain discharge has occurred. This wall charge adjustment pulse CP erases some of wall charges generated inside these discharge cells PC, thereby adjusting the amount of wall charges in each of the discharge cells PC to a level that can guarantee a selective erasure addressing discharge in the subsequent selective erasure addressing process $W_D$.

In a selective erasure addressing process $W_D$ of each of the subfields SF3 to SF14, the Y electrode driver 53 applies a base pulse $BP^+$ having a specific positive potential to each of the row electrodes $Y_1$ to $Y_n$ while sequentially applying an erase scan pulse $SP_D$ having a negative peak potential to each of the row electrodes $Y_1$ to $Y_n$ as shown in FIG. 4. The peak potential of the base pulse $BP^+$ is set to a level that can prevent the occurrence of an erroneous discharge between row electrodes. X and Y during the duration of the selective erasure addressing process $W_D$. The X electrode driver 51 sets each of the row electrodes $X_1$ to $X_n$ to ground (0V) during the duration of the selective erasure addressing process $W_D$. In addition, in the selective erasure addressing process $W_D$, the addressing driver 55 converts a bit corresponding to the subfield SF in the subfield data GD into a pixel data pulse DP having a peak potential according to a logic level of the corresponding bit. For example, the addressing driver 55 converts the third bit of the subfield data GD corresponding to the third subfield SF3 into a pixel data pulse DP having a positive peak potential when the third bit is at a logic level of "1" for switching the discharge cell PC from an emission mode to a non-emission mode. On the other hand, the addressing driver 55 converts the third bit of the subfield data GD corresponding to the third subfield SF3 into a low-voltage (i.e., 0V) pixel data pulse DP when the third bit is at a logic level of "0" for maintaining the current mode of the discharge cell PC. The addressing driver 55 sequentially applies such pixel data pulses DP one-display-line-by-one-display-line (i.e., m pixel data pulses DP at a time) to the column electrodes $D_1$ to $D_m$ in synchronization with application of erasure scan pulses $SP_D$. When the erasure scan pulse $SP_D$ is applied, a selective erasure addressing discharge occurs between a column electrode D and a row electrode Y in each of those discharge cells PC to which a high-voltage pixel data pulse DP has been applied. This selective erasure addressing discharge switches these discharge cells PC to a non-emission mode, i.e., a state in which positive wall charges are generated near each of the row electrodes X and Y and negative wall charges are generated near the column electrode D. On the other hand, when the erasure scan pulse $SP_D$ is applied, no selective erasure addressing discharge occurs between a column electrode D and a row electrode Y in each of those discharge cells PC to which a low-voltage (0V) pixel data pulse DP is applied. Thus, the discharge cell PC is kept in the immediately previous state, i.e., the emission or non-emission mode.

In the erasure process E of the last subfield SF14, the Y electrode driver 53 applies an erasure pulse EP having a negative peak potential to all the row electrodes $Y_1$ to $Y_n$. Upon application of the erasure pulse EP, an erasure discharge occurs only in those discharge cells PC that are in an emission mode. This erasure discharge switches these emission-mode discharge cells PC to a non-emission mode.

The above-described drive is performed based on 16 subfield data GD of 1st to 16th gray levels as shown in FIG. 3.

In the case of the second gray level representing luminance that is one level higher than that of the first gray level representing black (luminance level "0"), the panel driver induces a selective write addressing discharge for setting the discharge cell PC to an emission mode only in the subfield SF1 among the subfields SF1 to SF14 as shown in FIG. 3 and generates a weak light emission discharge in the emission-mode discharge cell PC (as denoted by "□"). Here, the luminance level of light emitted through the selective write addressing discharge and the weak light emission discharge is lower than that of light emitted through one sustain discharge. Accordingly, when the viewed (perceived) luminance level of light emitted through a sustain discharge is "1," the second gray level represents luminance at a luminance level "α" that is lower than the luminance level "1."

In the case of the second gray level representing luminance that is one level higher than that of the second gray level, the panel driver induces a selective write addressing discharge for setting the discharge cell PC to an emission mode only in the subfield SF2 among the subfields SF1 to SF14 as shown in FIG. 3 (as denoted by "◎") and induces a selective erasure addressing discharge for switching the discharge cell PC to a non-emission mode in the next subfield SF3 (as denoted by "●"). Accordingly, the third gray level represents luminance corresponding to a luminance level "1" as light is emitted through only one sustain discharge in the sustain process I of only the subfield SF2 among the subfields SF1 to SF14.

In the case of the fourth gray level representing luminance that is one level higher than that of the second gray level, first, the panel driver causes a selective write addressing discharge for setting the discharge cell PC to an emission mode in the subfield SF1 and causes a weak light emission discharge in the discharge cell PC set to an emission mode (as denoted by "□"). In the case of the fourth gray level, the panel driver causes a selective write addressing discharge for setting the discharge cell PC to an emission mode only in the subfield SF2 among the subfields SF1 to SF14 (as denoted by "◎") and causes a selective erasure addressing discharge for switching the discharge cell PC to a non-emission mode in the next subfield SF3 (as denoted by "●"). Accordingly, the fourth gray level represents luminance corresponding to a luminance level of a "α+1" since light of a luminance level of "α" is emitted in the subfield SF1 and one sustain discharge, which entails light emission of a luminance level of "1," also occurs in the subfield SF2.

In the case of each of the fifth to sixteenth gray levels, first, the panel driver causes a selective write addressing discharge for setting the discharge cell PC to an emission mode in the subfield SF1 and causes a weak light emission discharge in the emission-mode discharge cell PC (as denoted by "□"). The panel driver also induces a selective erasure addressing discharge for switching the discharge cell PC to a non-emission mode in only one subfield SF corresponding to that gray level (as denoted by "●"). Accordingly, in the case of each of the fifth to sixteenth gray levels, the panel driver causes the weak light emission discharge in the subfield SF1 and causes one sustain discharge in the subfield SF2. Thereafter, in each of continuous subfields corresponding to the gray level (as denoted by "○"), the panel driver causes a sustain discharge a number of times allocated to the subfield concerned. Thus, luminance corresponding to the sum of the luminance level "α" and the total number of sustain discharges occurring in a one-field (or one-frame) display period is viewed in each of the fifth to sixteenth gray levels. As a result, according to the above-described drive method, a range of luminance levels of "0" to "255+α" can be represented using the first to sixteenth gray levels as shown in FIG. 3.

In the above-described drive method, a weak light emission discharge rather than a sustain discharge is generated, as a discharge that contributes to a display image, in the subfield SF1 that has the smallest luminance weight. Since the weak light emission discharge occurs between column electrodes D and row electrodes Y, the level of luminance of light emitted through the weak light emission discharge is lower than that of the sustain discharge that occurs between row electrodes X and Y. Thus, the luminance difference between the first gray level (black: luminance level "0") and the second gray level (one level higher than black) is less when the luminance at the second gray level is represented through the weak light emission discharge, than when the second gray level is represented through the sustain discharge. This increases (enhances) the capability of representing gray levels of low luminance images. In the case of the second gray level, no reset discharge occurs in the second reset process R2 of the subfield SF2 subsequent to the subfield SF1, and therefore a reduction in the dark contrast due to the reset discharge is suppressed.

Although a weak light emission discharge, entailing light emission of a luminance level of "α," is generated in the subfield SF1 in each of the fourth and subsequent gray levels in the drive method shown in FIG. 3, the weak light emission discharge may not be generated in the fourth and subsequent gray levels for the following reason. Since light emitted through the weak light emission discharge has a very low luminance level (i.e., the luminance level "α"), it may not be possible to view or perceive a luminance increase by the luminance level "α" in the fourth and subsequent gray levels in which a sustain discharge entailing light emission of higher luminance is generated together with the weak light emission discharge. In this case, the need to generate the weak light emission discharge is eliminated.

In the plasma display device shown in FIG. 1, the peak potential setting unit 5 decides a negative peak potential PV of a reset pulse $RP2_{Y2}$, which is to be applied in the rear side of the second reset process R2 of the subfield SF2 shown in FIG. 4 or FIG. 5, based on the accumulated running time signal RT, the sustain pulse count signal SN, and the black display cell count signal BN.

More specifically, the peak potential setting unit 5 obtains the number of sustain pulses allocated to a subfield SF (i.e., the subfield SF2), which includes a sustain process I that is first performed after the second reset process R2 is performed, based on the sustain pulse count signal SN. Then, the peak potential setting unit 5 determines whether or not the number of sustain pulses allocated to the subfield SF2 is less than a predetermined number (for example, "3"). When the number of sustain pulses allocated to the subfield SF2 is equal to or higher than the predetermined number "3," the peak potential setting unit 5 sets a potential of "$-L_5$," which is the negative of a specific potential of "$L_5$," as the negative peak potential PV of the reset pulse $RP2_{Y2}$, regardless of the accumulated running time signal RT and the black display cell count signal BN.

On the other hand, when the number of sustain pulses allocated to the subfield SF2 is less than the predetermined number "3," the peak potential setting unit 5 sets a potential, which is the negative of a potential of $L_1$ to $L_5$ ($L_1<L_2<L_3<L_4<L_5$) that is determined based on the respective values of the accumulated running time signal RT and the black display cell count signal BN as shown in FIG. 6, as the negative peak potential PV of the reset pulse $RP2_{Y2}$.

More specifically, as shown in FIG. 6, when an accumulated running time indicated by the accumulated running time signal RT is shorter than a predetermined time B, the peak potential setting unit 5 sets a potential, which is the negative of a potential of "L" that decreases as the number of discharge cells that are in a black display state indicated by the black display cell count signal BN (i.e., the number of black display cells) increases, as the negative peak potential PV of the reset pulse $RP2_{Y2}$.

When the number of black display cells BN is equal to or greater than a predetermined number "b," the peak potential setting unit 5 sets a potential, which is the negative of a potential of "L" that decreases as the accumulated running time indicated by the accumulated running time signal RT decreases, as the negative peak potential PV of the reset pulse $RP2_{Y2}$.

When the number of sustain pulses allocated to the subfield SF2 is less than a predetermined number of "3" as shown in FIG. 4 under the conditions that the accumulated running time is shorter than the predetermined time "B" and that the number of black display cells is equal to or greater than the predetermined number "b," the peak potential setting unit 5 sets a potential, which is a negative value (a value to which—is added) of one of the potentials $L_1$ to $L_4$ below the potential $L_5$, as the negative peak potential PV of the reset pulse $RP2_{Y2}$. On the other hand, when the number of sustain pulses allocated to the subfield SF2 is equal to or greater than the predetermined number "3" as shown in FIG. 5, the peak potential setting unit 5 sets a potential, which is a negative value of the potential $L_5$, as the negative peak potential PV of the reset pulse $RP2_{Y2}$. That is, the peak potential setting unit 5 sets the absolute value of the negative peak potential PV of the reset pulse $RP2_{Y2}$ to a smaller value as the number of sustain pulses to be allocated to the subfield SF2 becomes smaller.

As described above, the peak potential setting unit 5 sets the negative peak potential PV of the reset pulse $RP2_{Y2}$ such that the absolute value of the negative peak potential PV decreases (moves toward 0V) as the number of discharge cells in a black display state "BN" increases. Accordingly, a voltage applied between row electrodes Y and X upon application of the reset pulse $RP2_{Y2}$ in the rear side of the second reset process R2 shown in FIG. 4 or 5 decreases as the number of discharge cells in a black display state "BN" increases, i.e., as the overall darkness of the display image increases. As the voltage applied between row electrodes Y and X decreases, the intensity of a reset discharge induced by the voltage also decreases and therefore the luminance of light emitted through the reset discharge decreases, thereby achieving an increase in the dark contrast.

However, as the intensity of the reset discharge decreases (i.e., the reset discharge is weakened), it is difficult to fully erase wall charges in the second reset process R2 and thus the amount of remaining wall charges may become greater than a predetermined amount (expected amount). Then, discharge cells in which no write addressing discharge occurs in the second selective write addressing process $W2_W$ immediately after the second reset process R2 (i.e., discharge cells that should be in a non-emission mode) may undergo an erroneous sustain discharge in the sustain process I immediately after the second selective write addressing process $W2_W$. Particularly, we found that the probability of occurrence of such an erroneous sustain discharge increases as the number of sustain pulses repeatedly applied in the sustain process I increases whereas it decreases as the number of applied sustain pulses decreases. We also found that, even though such an erroneous sustain discharge occurs, it is not visually perceived since luminance is not high when the number of sustain pulses is small (when the number of sustain pulses applied in the sustain process I is small).

Thus, when the number of sustain pulses "SN" allocated in the sustain process I is less than a predetermined number of "3," the peak potential setting unit 5 sets the absolute value of the negative peak potential PV of the second reset pulse $RP2_{Y2}$ to a lower value (one of $L_1$ to $L_4$) since an erroneous discharge hardly occurs or an erroneous discharge is not noticeable even if it occurs. Accordingly, the reset discharge is weakened to achieve an increase in the dark contrast. On the other hand, when the number of sustain pulses "SN" allocated in the sustain process I is equal to or greater than the predetermined number "3," the peak potential setting unit 5 sets the absolute value of the negative peak potential PV of the reset pulse $RP2_{Y2}$ to a higher value ($L_5$) than when the number of sustain pulses "SN" is less than "3." Accordingly, the intensity of the reset discharge is increased to the extent that the amount of wall charges remaining in all the discharge cells becomes less than a predetermined amount to prevent the occurrence of such an erroneous discharge.

In addition, plasma display panels have a tendency that sufficient discharges become difficult to occur after extensive accumulated running time.

Thus, as the accumulated running time signal RT increases, the peak potential setting unit 5 increases the absolute value of the negative peak potential PV of the reset pulse $RP2_{Y2}$ to increase the intensity of the reset discharge, thereby preventing the occurrence of the erroneous discharge.

Figure 7:
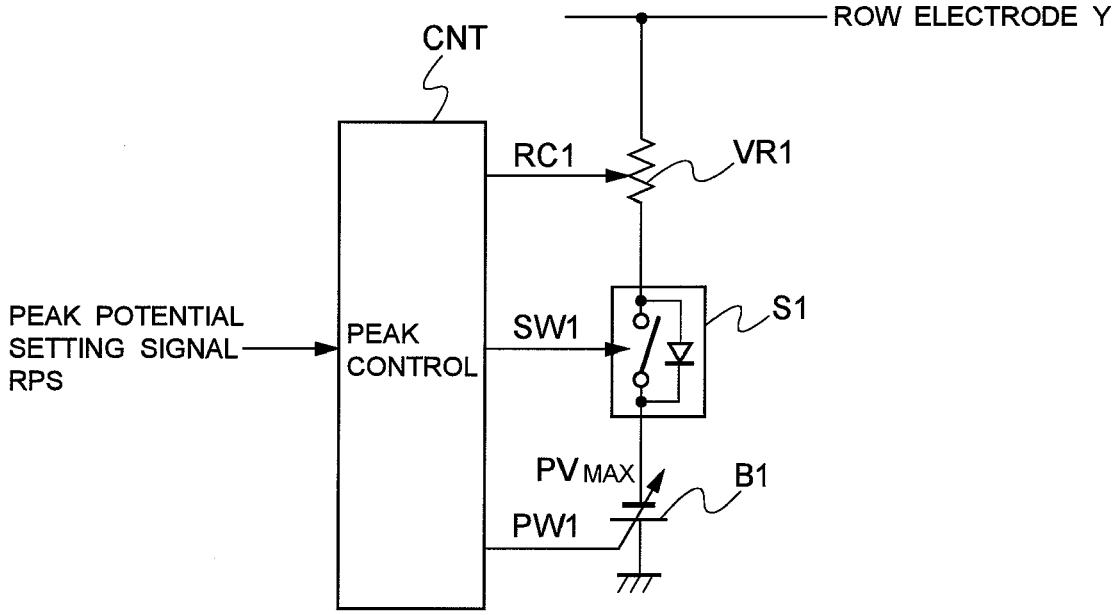
FIG. 7 illustrates a configuration of a second reset pulse generation circuit.

The Y electrode driver 53 includes a second reset pulse generation circuit as shown in FIG. 7 to generate the second reset pulse $RP2_{Y2}$ having the negative peak potential PV decided by the peak potential setting unit 5.

As shown in FIG. 7, the second reset pulse generation circuit includes a DC power source B1, a switching element S1, a variable resistor VR1, and a peak control circuit CNT.

According to a peak potential setting signal RPS received from the peak potential setting unit 5, the peak control circuit CNT supplies a switching signal SW1 to the switching element S1 to turn the switching element S1 on or off. When performing a peak potential control drive mode C (will be described below), the peak control circuit CNT supplies a power source voltage change signal PW1 to the DC power source B1 to change a potential $PV_{MAX}$ generated by the DC power source B1 to another negative potential according to the peak potential setting signal RPS. When performing a peak potential control drive mode D (will be described below), the peak control circuit CNT supplies a resistance change signal RC1 to the variable resistor VR1 to change resistance of the variable resistor VR1 according to the peak potential setting signal RPS.

When a switching signal SW1 (for example, a signal SW1 having a logic level of "1") indicating an on state is supplied to the switching element S1, the switching element S1 is turned on to permit the negative potential $PV_{MAX}$ generated by the DC power source B1 to be applied to all the row electrodes Y through the variable resistor VR1. When a switching signal SW1 (for example, having a logic level of "0") indicating an off state is provided to the switching element S1, the switching element S1 is turned off to set all the row electrodes Y to a high impedance state.

The peak control circuit CNT performs control based on one of the peak potential control drive modes A to D (will be described below) to generate, on row electrodes Y, a second reset pulse $RP2_{Y2}$ having a negative peak potential PV indicated by the peak potential setting signal RPS.

Figure 8E:
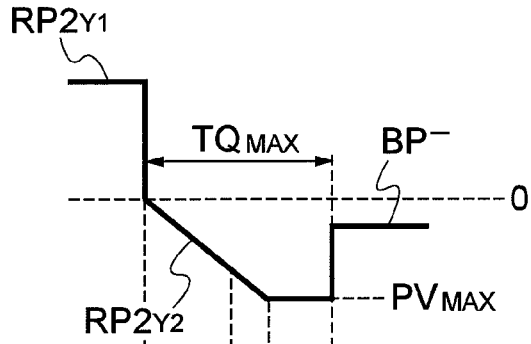
FIGS. 8A to 8E illustrate how the second reset pulse generation circuit operates to generate the second reset pulse in each of peak potential control drive modes A to D.
Figure 8A:
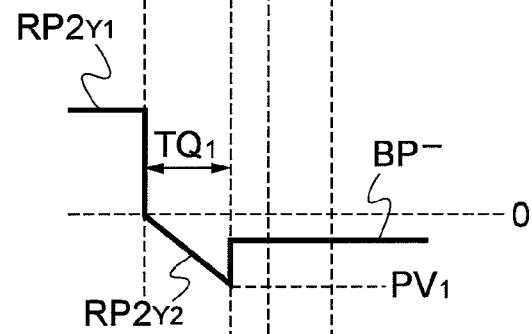

In the peak potential control drive mode A, the peak control circuit CNT keeps the switching element S1 in the on condition during a period according to the peak potential setting signal RPS. For example, when the switching element S1 is set to the on condition during a period $TQ_{MAX}$ as shown in FIG. 8E, the potential of row electrodes Y is gradually reduced and reaches a negative potential $PV_{MAX}$ generated by the DC power source B1. On the other hand, when the switching element S1 is kept to the on condition during a period $TQ_1$ shorter than the period $TQ_{MAX}$ as shown in FIG. 8A, the potential of row electrodes Y is gradually reduced until it reaches a potential $PV_1$ whose absolute value is smaller than the potential $PV_{MAX}$ of the period $TQ_{MAX}$. In this case, the potential $PV_1$ is the negative peak potential PV of the second reset pulse $RP2_{Y2}$. After the potential of the second reset pulse $RP2_{Y2}$ reaches $PV_1$, the Y electrode driver 53 immediately starts applying a base pulse $BP^-$ to the row electrodes Y in the second selective write addressing process $W2_W$ subsequent to the second reset process R2. Thus, in the peak potential control drive mode A, a second reset pulse $RP2_{Y2}$ having a waveform in which the potential of the row electrodes Y is gradually reduced until it reaches the negative peak potential $PV_1$ and is shifted to the potential of the base pulse $BP^-$ immediately after reaching the negative peak potential $PV_1$ is generated as shown in FIG. 8A.

In the peak potential control drive mode A, flickering may occur since the pulse width of the second reset pulse $RP2_{Y2}$ varies depending on the peak potential setting signal RPS. In this case, a period required for the addressing process ($W1_W$, $W2_W$, $W_D$) in each of the subfields SF1 to SF14 is extended by a time by which the pulse width of the second reset pulse $RP2_{Y2}$ has been reduced, so as to prevent such flickering.

Figure 8B:
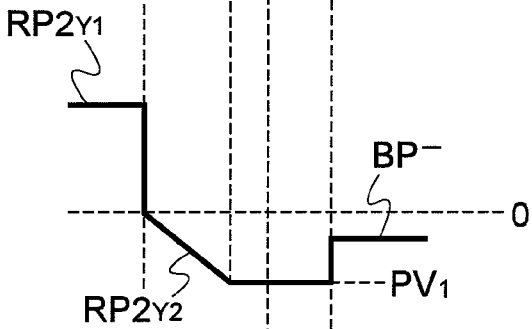

In the peak potential control drive mode B, the peak control circuit CNT keeps the switching element S1 to the on condition during a period according to the peak potential setting signal RPS. For example when the switching element S1 is set to the on condition during a period $TQ_{MAX}$ as shown in FIG. 8E, the potential of row electrodes Y is gradually reduced and reaches a negative potential $PV_{MAX}$ generated by the DC power source B1 in the same manner as in the peak potential control drive mode A. In this case, the potential $PV_{MAX}$ is the negative peak potential PV of the second reset pulse $RP2_{Y2}$. On the other hand, when the switching element S1 is kept to the on condition during a period $TQ_1$ shorter than the period $TQ_{MAX}$ as shown in FIG. 8B, the potential of row electrodes Y is gradually reduced until it reaches a potential $PV_1$ whose absolute value is less than the potential $PV_{MAX}$ of the period $TQ_{MAX}$. In this case, the potential $PV_1$ is the negative peak potential PV of the second reset pulse $RP2_{Y2}$. After the potential of the second reset pulse $RP2_{Y2}$ reaches $PV_1$, the peak control circuit CNT switches the switching element S1 to the off condition to bring the row electrodes Y into a high impedance state. After this state is maintained for a predetermined period ($TQ_{MAX}$-$TQ_1$), the Y electrode driver 53 starts applying a base pulse $BP^-$ to the row electrodes Y in the second selective write addressing process $W2_W$ subsequent to the second reset process R2. Thus, according to the peak potential control drive mode B, a second reset pulse $RP2_{Y2}$ having a waveform in which the potential of the row electrodes Y is gradually reduced until reaching the negative peak potential $PV_1$ and is maintained at the negative peak potential $PV_1$ during the predetermined period ($TQ_{MAX}$-$TQ_1$) is generated as shown in FIG. 8B.

Figure 8C:
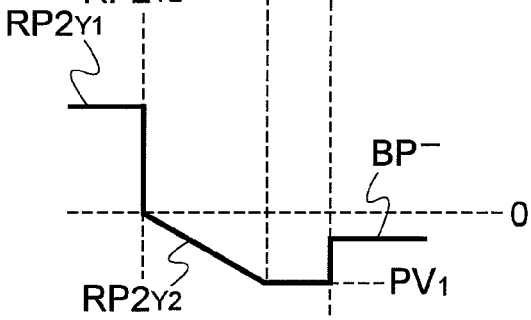

In the peak potential control drive mode C, the peak control circuit CNT keeps the switching element S1 to the on condition during the period $TQ_{MAX}$ and changes a negative potential $PV_{MAX}$, which is to be generated by the DC power source B1, to another potential in response to (or based on) the peak potential setting signal RPS. Thus, when the negative potential $PV_{MAX}$ which is to be generated by the DC power source B1 is changed to a potential $PV_1$ smaller than the potential $PV_{MAX}$ in the peak potential control drive mode C, a second reset pulse $RP2_{Y2}$ having a waveform in which the potential of the row electrodes Y reaches the negative peak potential $PV_1$ earlier than in the case of FIG. 8E is generated as shown in FIG. 8C.

Figure 8D:
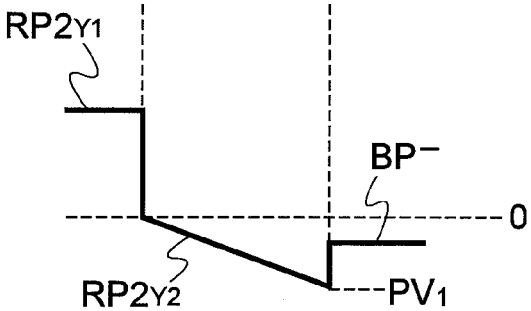

In the peak potential control drive mode D, the peak control circuit CNT keeps the switching element S1 in the on condition during the period $TQ_{MAX}$ and changes the resistance of the variable resistor VR1 in response to (or based on) the peak potential setting signal RPS. Thus, in the peak potential control drive mode D, as the resistance of the variable resistor VR1 increases, the potential change rate during the falling edge of the second reset pulse $RP2_{Y2}$ drops so that a value that the negative peak potential finally reaches decreases correspondingly as shown in FIG. 8D.

Although the reset pulses $RP1_{Y1}$ and $RP2_{Y1}$ are applied to the row electrodes $Y_1$ to $Y_n$ in the front sides of the reset processes R1 and R2 shown in FIG. 4 or 5 to induce the first reset discharge as a column-side cathode discharge, this is not the requisite. Specifically, one or both of the reset pulses $RP1_{Y1}$ and $RP2_{Y1}$ may not be applied.

Figure 9:
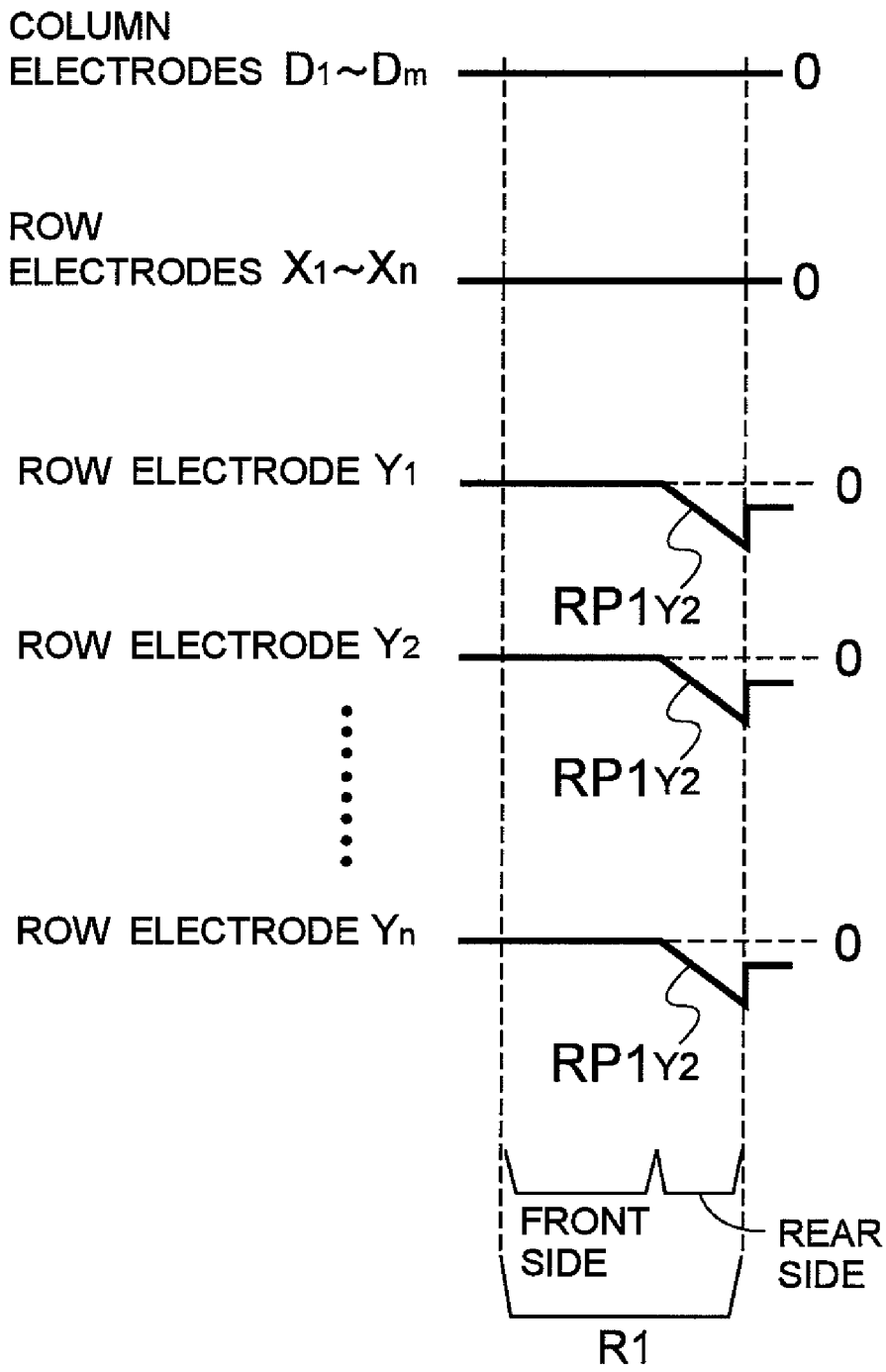
FIG. 9 illustrates another application pattern of reset pulses in the first reset process shown in FIG. 4 or 5.
Figure 10:
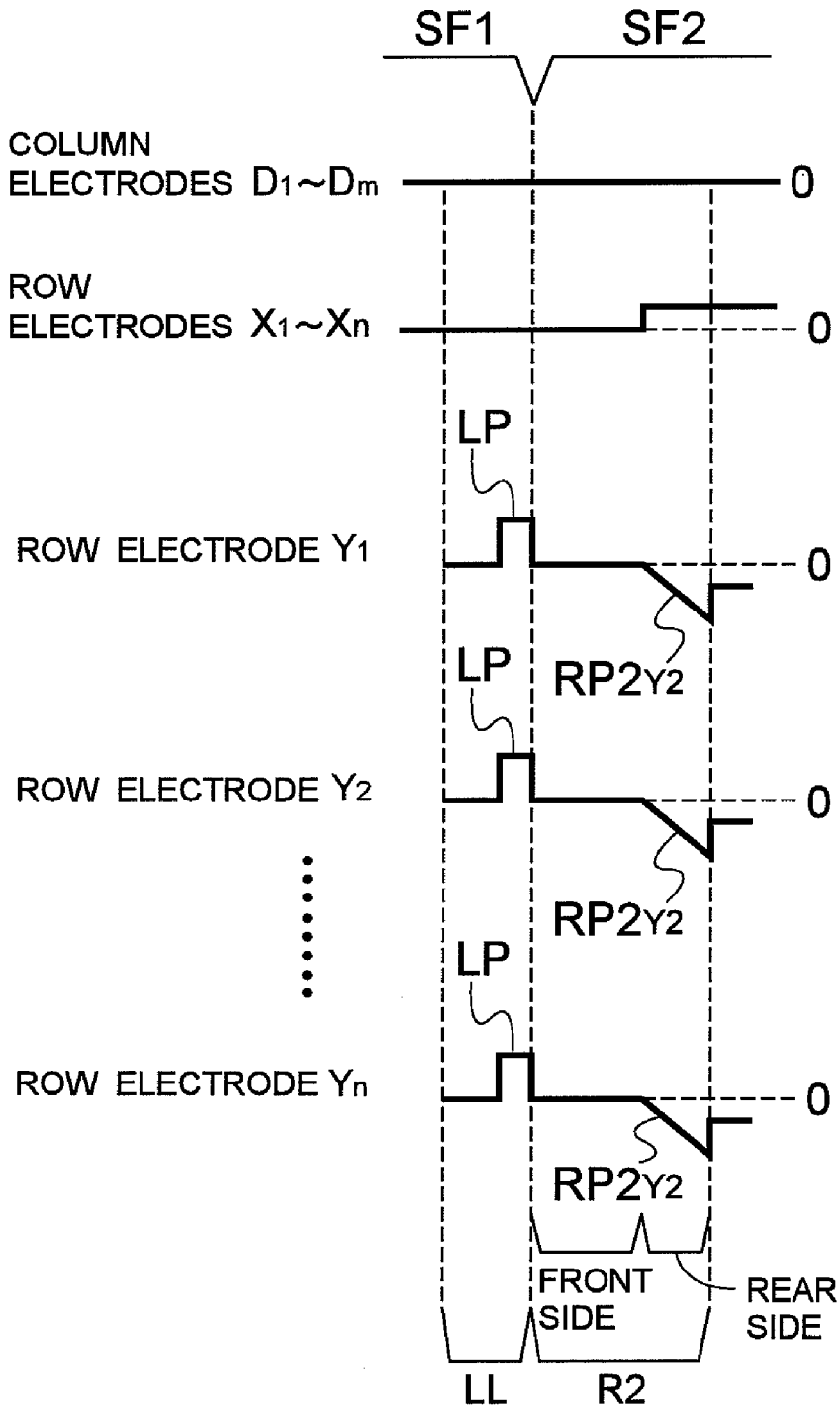
FIG. 10 illustrates another application pattern of reset pulses in the second reset process shown in FIG. 4 or 5.

For example, the first reset process R1 shown in FIG. 9 is employed in place of the first reset process R1 shown in FIG. 4 or 5. The row electrodes $Y_1$ to $Y_n$ are fixed to ground in the front side of the first reset process R1 shown in FIG. 9. In addition, the second reset process R2 shown in FIG. 10 may be employed in place of the second reset process R2 shown in FIG. 4 or 5. In this case, the row electrodes $Y_1$ to $Y_n$ are fixed to ground in the front side of the second reset process R2 shown in FIG. 10.

Although the peak potential setting circuit 5 uses the accumulated running time signal RT, the sustain pulse count signal SN, and the black display cell count signal BN as parameters for generating the peak potential setting signal RPS in the above-described embodiments, the accumulated running time signal RT may be omitted from these parameters.

Although the number of sustain pulses that are to be applied in the sustain process I of the subfield SF2 is exemplified by "1" (in the example shown in FIG. 4) and "3" (in the example shown in FIG. 5) in the foregoing description, a larger number of sustain pulses may be applied in the sustain process I.

An external optical sensor (not shown) may be installed for detecting luminance of ambient regions around the screen of the PDP 50. When the luminance of ambient regions is higher than a predetermined level, the peak potential setting circuit 5 may fixedly set the negative peak potential of the second reset pulse $RP2_{Y2}$ to a negative potential having a larger absolute value (for example, a potential $L_5$ shown in FIG. 6), regardless of the black display cell count signal BN. That is, even though the reset discharge is weakened to increase the dark contrast, this change is hardly perceived by viewers in the case where they watch the PDP in a relatively bright environment. Thus, the absolute value of the negative peak potential of the second reset pulse $RP2_{Y2}$ is set to a larger value to prevent erroneous discharges in the sustain process I.

Although the preferred embodiments of the present invention have been disclosed for illustrative purposes, those skilled in the art will appreciate that various changes, modifications, additions and substitutions are possible, without departing from the scope and spirit of the invention as disclosed in the accompanying claims.

This application is based on Japanese Patent Application No. 2008-64243 filed on Mar. 13, 2008 and the entire disclosure thereof is incorporated herein by reference.

What is claimed is:

1. A method for driving a plasma display panel based on pixel data of pixels derived from an image signal, the plasma display panel including a first substrate, a second substrate, a plurality of row electrode pairs provided on the first substrate and a plurality of column electrodes provided on the second substrate, discharge cells being formed respectively at intersections of the plurality of row electrode pairs with the plurality of column electrodes, and a unit display period of the image signal being divided into a plurality of subfields, said method comprising:

an addressing process for setting each said discharge cell to either an emission mode or a non-emission mode in each said subfield;

a sustain process for applying a sustain pulse in each said subfield;

a reset process for applying a reset pulse to one row electrode of two row electrodes in each said row electrode pair in one of said subfields of each said unit display period prior to the addressing process so as to initialize each of the discharge cells; and an adjusting process for adjusting a peak potential of the reset pulse based on a number of those discharge cells that are maintained in the non-emission mode during the unit display period and on the number of times the sustain pulse is to be applied in the sustain process in said one of said subfields, wherein the reset process includes a front half process for applying a first reset pulse to the one of two row electrodes in said row electrode pair and a rear half process subsequent to the front half process for applying a second reset pulse within the same one of said subfields to the one of two row electrodes in said row electrode pair, the second reset pulse being opposite in polarity to the first reset pulse, and wherein a peak potential of the second reset pulse is adjusted based on the number of those discharge cells that are maintained in the non-emission mode during the unit display period and the number of times the sustain pulse is to be applied in the sustain process in said one of said subfields.

2. The method according to claim 1, wherein, when the number of times the sustain pulse is to be applied in the sustain process of said one of said subfields is less than a predetermined number, an absolute value of the peak potential of the reset pulse is set to be smaller than when the number of times the sustain pulse is to be applied in the sustain process of said one of said subfields is equal to or greater than the predetermined number.

3. The method according to claim 1, wherein, in the addressing process of said one of said subfields, each of the discharge cells is switched to the emission mode from the non-emission mode upon an addressing discharge that is selectively generated in the discharge cell based on the pixel data.

4. The method according to claim 1, wherein the peak potential of the reset pulse is adjusted based on an accumulated running time of the plasma display panel.

5. The method according to claim 1, wherein an absolute value of the peak potential of the reset pulse is reduced as the number of discharge cells that are maintained in the non-emission mode during the unit display period increases.

* * * * *